US007021317B1

(12) United States Patent
Nathaniel

(10) Patent No.: US 7,021,317 B1
(45) Date of Patent: Apr. 4, 2006

(54) HAIR CLIP ASSEMBLY

(76) Inventor: Michele Nathaniel, 6027 Hazelhurst St., Philadelphia, PA (US) 19151

( * ) Notice: Subject to any disclaimer, the term of this patent is extended or adjusted under 35 U.S.C. 154(b) by 205 days.

(21) Appl. No.: 10/685,357

(22) Filed: Oct. 14, 2003

(51) Int. Cl.
*A45D 19/18* (2006.01)

(52) U.S. Cl. ..... 132/270

(58) Field of Classification Search ..... 132/222, 132/270, 208, 223, 224, 276, 277, 278, 212
See application file for complete search history.

(56) References Cited

U.S. PATENT DOCUMENTS

| | | | | |
|---|---|---|---|---|
| 1,550,930 | A * | 8/1925 | Sullivan | 132/212 |
| 2,883,993 | A * | 4/1959 | Laughton | 132/277 |
| 2,897,825 | A * | 8/1959 | Wagner | 132/279 |
| 3,543,771 | A * | 12/1970 | Altman | 132/222 |
| 3,861,405 | A | 1/1975 | Pellecchia | 132/9 |
| 4,398,549 | A | 8/1983 | Thomas | 132/9 |
| 4,830,030 | A | 5/1989 | Busch et al. | 132/212 |
| 5,865,190 | A * | 2/1999 | Butler | 132/208 |
| 6,135,123 | A * | 10/2000 | Grassi et al. | 132/213 |
| 2004/0065341 | A1* | 4/2004 | La Fauci | 132/277 |
| 2005/0039768 | A1* | 2/2005 | Winckels | 132/208 |

FOREIGN PATENT DOCUMENTS

JP 2000253922 A * 9/2000

* cited by examiner

*Primary Examiner*—John J. Wilson
*Assistant Examiner*—Robyn Doan
(74) *Attorney, Agent, or Firm*—Stuart M. Goldstein

(57) ABSTRACT

A hair clip assembly for protecting pretreated hair from damaging effects of a treatment chemical applied to new hair growth. The hair clip assembly comprises two spring-biased jaw members, each having a substantially flat, rectangular hair shield extending therefrom. After selective attachment of the hair clip assembly to a section of hair, in proximity to the junction between the pretreated hair and the new hair growth, the hair shields protect the pretreated hair from needless exposure to the treatment chemical.

10 Claims, 3 Drawing Sheets

HAIR CLIP ASSEMBLY

BACKGROUND OF THE INVENTION

1. Field of the Invention

The invention generally relates to a hair clip assembly for selective attachment to groups of hair strands, and in particular relates to a hair clip assembly for shielding pretreated portions of hair strands from a treatment chemical which is being selectively applied only to new hair growth.

2. Description of the Related Art

A large number of individuals periodically apply a variety of treatment chemicals to their hair. These chemicals include conditioners and fixing preparations such as bleaches, tints, and dyes. These chemicals are often harsh and may cause damage to the hair after repeated use. Oftentimes, the individual will need to reapply a particular treatment chemical on subsequent occasions, in order to treat the new hair growth with the treatment chemical. For example, an individual who colors his/her hair will periodically need to dye the new hair growth, in order to ensure that the entire length of each strand of hair is uniformly colored by the dye. Generally, this process involves reapplying the dye to the entire length of the hair, thereby unnecessarily exposing the pretreated portions of the hair to the damaging effects of the dye. Accordingly, there is a need for a hair clip assembly which is capable of shielding pretreated portions of hair strands from a treatment chemical which is being applied to the new hair growth, in order to spare the pretreated hair from the potentially damaging effects of harsh treatment chemicals.

A variety of hair clip assemblies have been devised for use while coloring or bleaching hair. For example, U.S. Pat. No. 4,830,030 to Busch appears to show a hair clip assembly comprised of clamping jaws suited for holding freshly died hair upon a curler until the dye has fixed. Additionally, U.S. Pat. No. 3,861,405 to Pellecia appears to show a hair clip assembly for frosting or straightening hair, comprising two biased jaw members which are releasably attached to the hair. Moreover, U.S. Pat. No. 4,398,549 to Thomas appears to show a hair clip assembly having a clamp bar which clamps the hair strands to be frosted, bleached, or dyed against the inner surface of a container.

None of these devices appears to disclose a hair clip assembly capable of protecting pretreated portions of hair strands from the damaging effects of a treatment chemical applied to the new hair growth. While these devices may be suitable for the particular purpose employed, or for general use, they would not be as suitable for the purposes of the present invention as disclosed hereafter.

SUMMARY OF THE INVENTION

It is an object of the invention to provide a hair clip assembly which allows a professional stylist to color or bleach the new hair growth while protecting pretreated hair from needless exposure to the adverse effects of a treatment chemical. Accordingly, the hair clip assembly has two jaw members and two substantially rectangular hair shields extending therefrom. The shields cover and protect the pretreated portions of the hair, while exposing the new hair growth, thereby allowing the professional stylist to color or bleach the new hair growth while protecting the pretreated hair from needless exposure to the adverse effects of the treatment chemical.

It is another object of the invention to provide a hair clip assembly which may be easily used by a layperson as well as by a professional stylist. Accordingly, the jaw members of the hair clip assembly are spring-biased to a closed position, thereby allowing the layperson to hold a section of hair within one hand while applying the hair clip assembly to the section of hair with the other hand, thereby providing a hair clip assembly which may be easily used by the layperson as well as by the professional stylist.

It is yet another object of the invention to provide a hair clip assembly which is not unduly expensive. Accordingly, the materials from which the hair clip assembly is constructed are readily available, and its cost is not prohibitive.

Further objects of the invention will become apparent in the detailed description of the invention which follows.

The invention is a hair clip assembly for protecting pretreated hair from damaging effects of a treatment chemical applied to new hair growth. The hair clip assembly comprises two spring-biased jaw members, each having a substantially flat, rectangular hair shield extending therefrom. After selective attachment of the hair clip assembly to a section of hair, in proximity to the junction between the pretreated hair and the new hair growth, the hair shields protect the pretreated hair from needless exposure to the treatment chemical.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
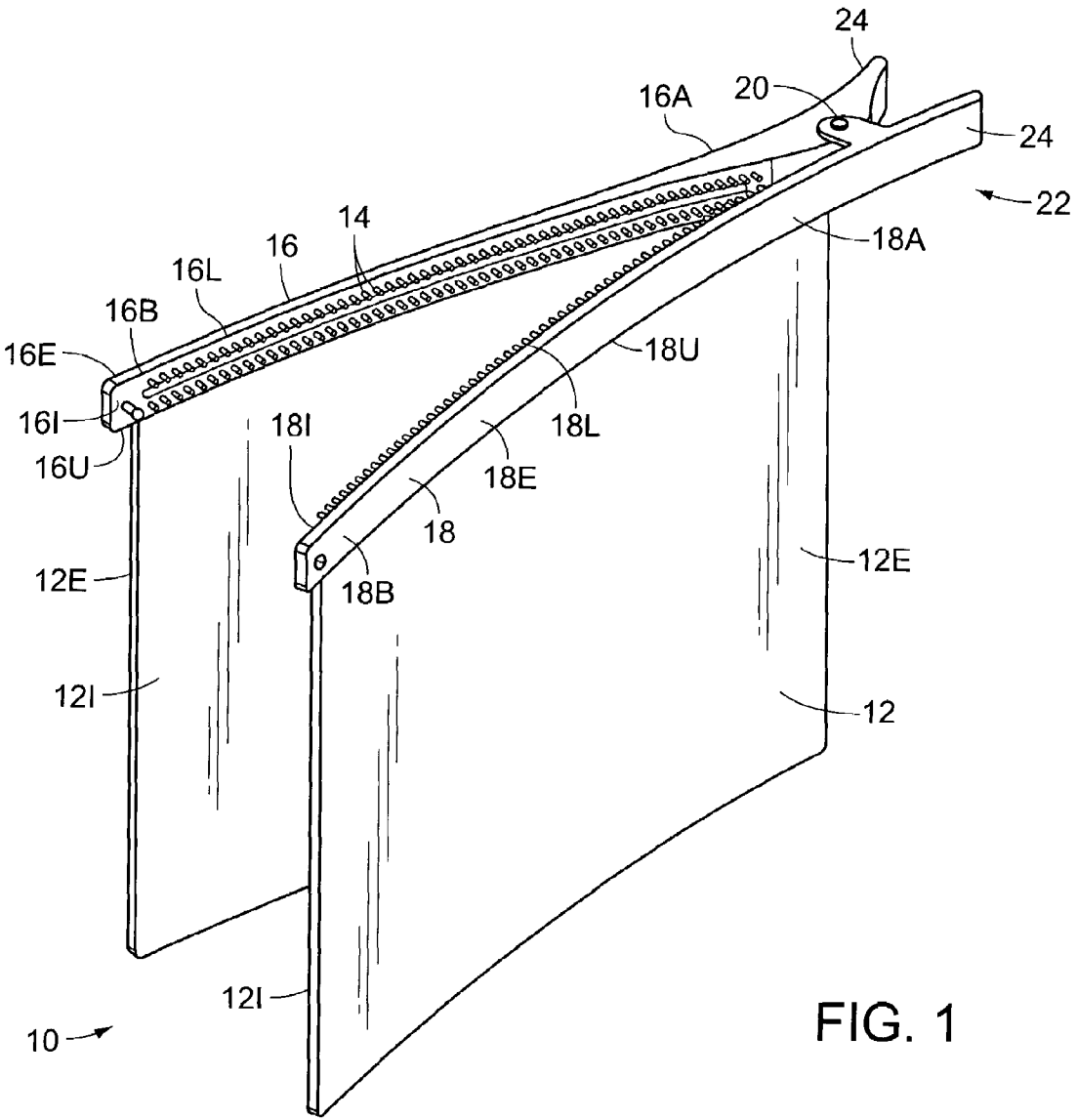
FIG. 1 is a perspective view of a hair clip assembly, wherein the jaw members are in an open position.

FIG. 1 illustrates a hair clip assembly 10 for use by a user having a scalp having a plurality of hairs, each hair having a pretreated portion which was treated by a treatment chemical on a prior occasion, each hair also having a new growth portion which has not been previously treated by the treatment chemical. The hair clip assembly 10 protects the pretreated portions of the hair from the damaging effects of the treatment chemical applied to the new hair growth portions of the hair. The hair clip assembly 10 comprises a first jaw member 16, and a second jaw member 18 pivotally attached to the first jaw member 16. The first jaw member 16 has a first end 16A and a second end 16B. Analogously, the second jaw member 18 has a first end 18A and a second end 18B. The jaw members 16 and 18 are pivotally attached to one another in proximity to their first ends 16A and 18A, respectively, by a hinge 20. The substantially rectangular jaw members 16 and 18 have an open position and a closed position. FIG. 1 illustrates the jaw members 16 and 18 in the open position, wherein the jaw members 16 and 18 have been swiveled away from one another upon the hinge 20. The hair clip assembly 10 has a coiled spring 22 in proximity to the first ends 16A and 18A of the jaw members 16 and 18, respectively. The spring 22 biases the jaw members 16 and 18 to the closed position.

The jaw member 16 has an internally oriented surface 16I, an externally oriented surface 16E, a lower surface 16L, and an upper surface 16U. Analogously, the jaw member 18 has an internally oriented surface 18I, an externally oriented surface 18E, a lower surface 18L, and an upper surface 18U. Each of the jaw members 16 and 18 has a plurality of teeth 14 extending perpendicularly outward from the internally oriented surfaces 16I and 18I, respectively. The teeth 14 of jaw member 16 selectively interlocks with the teeth 14 of jaw member 18 when the jaw members 16 and 18 are in the closed position. The interlocking teeth 14 of the jaw members 16 and 18 strengthen the hold of the jaw members 16 and 18 onto the strands of hair onto which the hair clip assembly 10 has been selectively attached, thereby making it impossible for the jaw members 16 and 18 to inadvertently separate during use.

Each of the jaw members 16 and 18 has a substantially flat, rectangular hair shield 12 extending perpendicularly from the upper surfaces 16U and 18U, respectively. Each hair shield 12 has an internally oriented surface 12I and an externally oriented surface 12E. When the hair clip assembly 10 is used to protect the pretreated portions of the hair from treatment chemicals, the jaw members 16 and 18 are in the closed position, the pretreated portions of the hair are sandwiched between the two hair shields 12, and the internally oriented surfaces 12I of each of the shields 12 are pressed by the bias of the spring 22 against one another. The hair shields 12 cover and protect the pretreated portions of the hair from becoming unnecessarily damaged during application of a treatment chemical to the new hair growth portions.

The jaw members 16 and 18 each have a beveled grip 24 at their first ends, 16A and 18A, respectively. The beveled grips 24 provide an easily grippable surface for a user. The jaw members 16 and 18 are opened by the user squeezing the beveled grips 24 towards one another. After positioning the pretreated portions of the hair between the selectively opposable hair shields 12, the jaw members 16 and 18 are allowed to close by releasing the beveled grips 24, thereby allowing the spring 22 to bias the jaw members 16 and 18 to the closed position. The user may now apply a treatment chemical to new hair growth portions without needlessly reapplying the treatment chemical to the pretreated portions of the hair, thereby preventing unnecessary exposure of the hair to the often harsh treatment chemicals which are employed.

Figure 2:
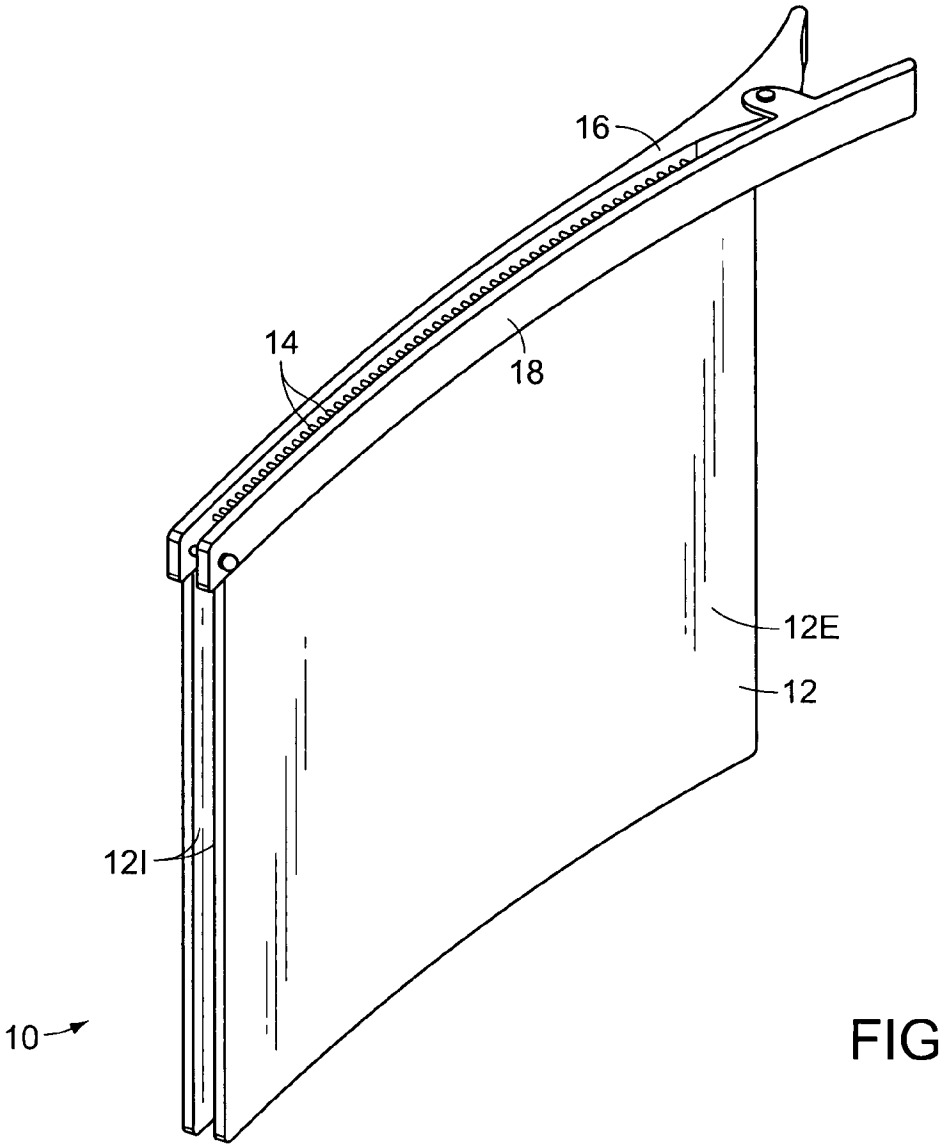
FIG. 2 is a perspective view of the hair clip assembly, wherein the jaw members are in a closed position.

FIG. 2 illustrates the hair clip assembly 10, wherein the jaw members 16 and 18 are in the closed position. The internally oriented surfaces 12I of each hair shield 12 are pressed substantially flush against one another. The teeth 14 of the jaw members 16 engage the teeth 14 of the jaw member 18.

Figure 3:
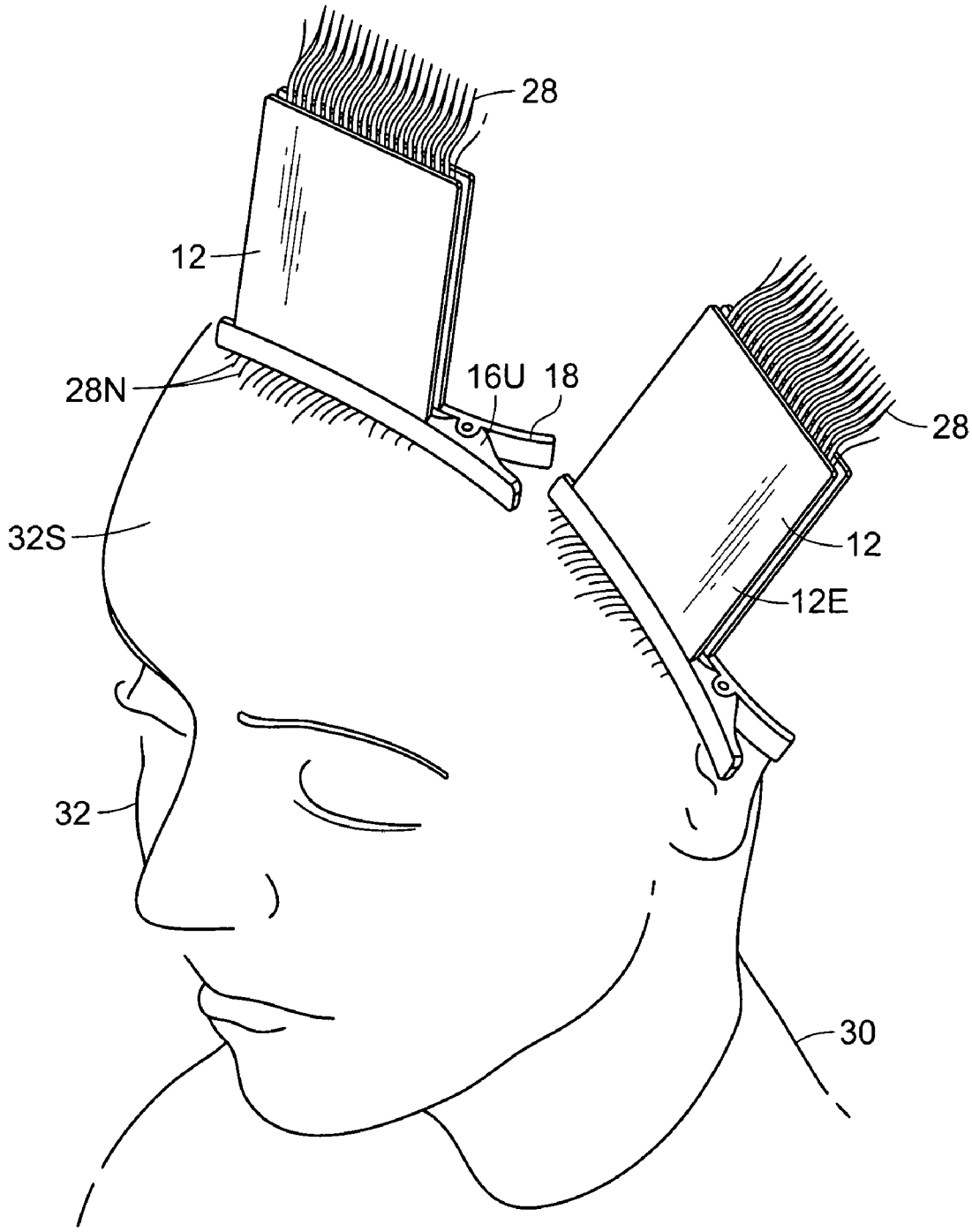
FIG. 3 is a perspective view of two hair clip assemblies in use, wherein portions of pretreated hair have been sandwiched between two selectively opposable hair shields, in order to protect the pretreated hair from damaging effects of a treatment chemical applied to the new hair growth portions of the hair.

FIG. 3 illustrates two hair clip assemblies 10 being utilized by a user 30 having a head 32 having a scalp 32S. The scalp 32S has a plurality of hairs 28 extending therefrom. Each of the hairs 28 is attached to the scalp 32S by a root 28R. Each hair 28 has a pretreated portion which has been treated on a prior occasion and consequently, does not need to be treated again at this time. However, each hair 28 also has a new hair growth portion 28N which has grown since the prior exposure of the hair 28 to the treatment chemical. The pretreated portions of the hairs 28 have been sandwiched between the shields 12. The shields 12 prevent the treatment chemical from contacting and needlessly damaging the pretreated portions of the hairs 28. However, the new hair growth portions 28N of the hair 28 have not been treated previously. Hence, the new hair growth portions 28N are not covered by the shields 12. Accordingly, the treatment chemical applied to the hairs 28 are able to interact with the new hair growth portions 28N.

The jaw members 16 and 18 may be constructed from a variety of materials and are preferably constructed from stainless steel or plastic. The portions of the hair clip assembly 10 which contact the user's hair are lined with a soft, polystyrene material in order to prevent damage to the hair during use. The beveled grips 26 are preferably constructed from a non-slippery rubber material, in order that the hair clip assembly 10 will not inadvertently slip from the hands of the user while it is being selectively attached to the user's hair.

Although the hair clip assembly 10 is suitable for use in bleaching or coloring hair, it is contemplated that the hair clip assembly will be additionally utilized when "perming" new hair growth on African American hair.

In use, the user divides the hair 28 into sections to be treated. The user holds the hair clip assembly 10 by its beveled grips 26 within one hand while using the other hand to lift a section of the hair 28 away from the scalp 32S. The user aligns the lower surfaces 16L and 18L of the jaw members 16 and 18, respectively, along the junction between the new hair growth portions 28N and the pretreated portions of the hair 28. The user releases the beveled grips 26, thereby allowing the jaw members 16 and 18 to close and firmly grasp the hairs 28. The user then applies the treatment chemical to the new hair growth portions 28N, while sparing the pretreated portions of the hair 28 from the damaging effects of the treatment chemical. The process is repeated for all the remaining sections of hair 28.

In conclusion, herein is presented a hair clip assembly, for protecting pretreated portions of hair from the damaging effects of a treatment chemical applied to the new hair growth portions. The invention is illustrated by example in the drawing figures, and throughout the written description. It should be understood that numerous variations are possible, while adhering to the inventive concept. Such variations are contemplated as being a part of the present invention.

What is claimed is:

1. A hair clip assembly for use by a user having hands, and having a head having a scalp having a plurality of hairs, wherein each of the hairs has a root, a pretreated portion which has been treated by a treatment chemical on a prior occasion, and a new hair growth portion which has not been treated by the treatment chemical on the prior occasion, said hair clip assembly for protecting the pretreated portions of the plurality of hairs from the damaging effects of the treatment chemical applied to the new hair growth portions, comprising:

a first jaw member, and a second jaw member substantially the same length as the first jaw member pivotally attached to the first jaw member by a hinge wherein the pivotal attachment permits the jaw members to assume open and closed positions in relation to each other by movement of both jaw members toward and away from each other, each jaw member having a first end, a second end, an internally oriented surface, an externally oriented surface, a lower surface, and an upper surface;

a coiled spring in proximity to the adjacent first ends of the jaw members, wherein the coiled spring biases and moves both jaw members towards the closed position such that in the closed position all surfaces of the first jaw member are substantially adjacent and parallel to the corresponding surfaces of the second jaw member; and a first unitary hair shield secured to and extending perpendicularly from the upper surface of the first jaw member and a second separate unitary hair shield secured to and extending perpendicularly from the upper surface of the second jaw member, each hair shield having an internally oriented surface, wherein when the jaw members are biased in the closed position, the two shields are also biased closed such that their internally oriented surfaces are pressed substantially flush against each other and wherein while the hair clip assembly is being used to protect the pretreated portions of the hair during application of the treatment chemical to the new hair growth portions, the jaw members are in the closed position, the pretreated portions of the hair are sandwiched between the internally oriented surfaces of the two hair shields, and the hair shields cover and protect the pretreated portions of the hair from needless exposure to the treatment chemical.

2. The hair clip assembly as recited in claim 1, wherein each of the hair shields is substantially flat and rectangular.

3. The hair clip assembly as recited in claim 2, wherein each of the jaw members has a plurality of teeth extending perpendicularly outward from its internally oriented surface, wherein the teeth of the first jaw member selectively interlock with the teeth of the second jaw member when the jaw members are in the closed position, thereby strengthening the hold of the jaw members onto the plurality of hairs onto which the hair clip assembly has been selectively attached.

4. The hair clip assembly as recited in claim 1, wherein each of the jaw members has a beveled grip at its first end, wherein the beveled grips provide an easily grippable surface for the user, wherein the jaw members are opened by the user squeezing the beveled grips towards one another, and wherein after positioning the pretreated portion of the hair between the hair shields, the jaw members are allowed to close by releasing the beveled grips, thereby allowing the spring to bias the jaw members to the closed position.

5. The hair clip assembly as recited in claim 4, wherein the portions of the hair clip assembly which contact the hair of the user are lined with a soft, polystyrene material in order to prevent damage to the plurality of hairs during use of the hair clip assembly.

6. The hair clip assembly as recited in claim 5, wherein the beveled grips are constructed from a non-slippery rubber material, in order that the hair clip assembly will not inadvertently slip from the hands of the user during use.

7. The hair clip assembly as recited in claim 6, wherein the jaw members are substantially rectangular.

8. The hair clip assembly as recited in claim 7, wherein the jaw members are constructed from stainless steel.

9. The hair clip assembly as recited in claim 8, wherein the jaw members are constructed from plastic.

10. A method of protecting pretreated portions of hair from the damaging effects of a treatment chemical applied to the new hair growth portions of the hair, by a user having two hands, a head having a scalp having a plurality of hairs extending therefrom, wherein each of the hairs has a root by which it is attached to the scalp, a pretreated portion of the hair which has been treated on a prior occasion, and a new hair growth portion which has not been treated on the prior occasion, said method using at least two hair clip assemblies, each hair clip assembly having a first jaw member, and a second jaw member pivotally attached to the first jaw member, each jaw member having a first end, a second end, a lower surface, an upper surface, an internally oriented surface, and an externally oriented surface, wherein the jaw members are pivotally attached to one another in proximity to their first ends, said jaw members having an open position wherein the jaw members have been swiveled away from one another, and a closed position wherein the jaw members have been swiveled towards one another, wherein the jaw members are biased towards the closed position, each hair clip assembly having a hair shield extending perpendicularly from the upper surfaces of each of the jaw members, said method comprising the steps of:

a) dividing the plurality of hairs by the user into at least two sections;

b) holding one of the at least two hair clip assemblies by the first ends of the jaw members within one hand while using the other hand to lift one of the at least two sections of the plurality of hairs away from the scalp;

c) opening the jaw members by pressing the first ends of the jaw members towards one another;

d) interposing the pretreated portions of the hair of said section between the shields and aligning the lower surfaces of the jaw members along the junction between the new hair growth portions and the pretreated portions;

e) releasing the first ends of the jaw members, thereby allowing the jaw members to close and firmly grasp the hairs in proximity to the roots, thereby sandwiching the pretreated portions of the hairs between the shields, while leaving the new hair growth portions exposed;

f) repeating steps (b) through (e) for each of the remaining at least one section of hair; and g) applying the treatment chemical to the exposed new hair growth portions, while sparing the pretreated portions of hair from the damaging effects of the treatment chemical.

* * * * *